US006791514B2

(12) United States Patent
Setoguchi et al.

(10) Patent No.: US 6,791,514 B2
(45) Date of Patent: Sep. 14, 2004

(54) PLASMA DISPLAY AND METHOD OF DRIVING THE SAME

(75) Inventors: Noriaki Setoguchi, Kawasaki (JP); Tomokatsu Kishi, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 232 days.

(21) Appl. No.: 10/033,898

(22) Filed: Jan. 3, 2002

(65) Prior Publication Data

US 2003/0001801 A1 Jan. 2, 2003

(30) Foreign Application Priority Data

Jun. 27, 2001 (JP) ..... 2001-194823

(51) Int. Cl.[7] ..... G09G 3/28
(52) U.S. Cl. ..... 345/60; 345/62; 345/68
(58) Field of Search ..... 345/60, 67, 68, 345/69, 62; 315/169.4, 169.1, 168; 313/231.31

(56) References Cited

U.S. PATENT DOCUMENTS 5,446,344 A * 8/1995 Kanazawa ..... 315/169.4
5,757,342 A * 5/1998 Hayashi ..... 345/60
5,952,986 A * 9/1999 Nguyen et al. ..... 345/68
6,081,245 A * 6/2000 Abe ..... 345/60
6,084,558 A * 7/2000 Setoguchi et al. ..... 345/60
6,288,692 B1 9/2001 Kanazawa et al.

FOREIGN PATENT DOCUMENTS

EP 0 762 373 3/1997

* cited by examiner

*Primary Examiner*—Richard Hjerpe
*Assistant Examiner*—Fritz Alphonse
(74) *Attorney, Agent, or Firm*—Staas & Halsey LLP

(57) ABSTRACT

In a plasma display, a plurality of first display electrodes and a plurality of second electrodes are arranged in parallel with one another and in which a plurality of addressing electrodes are arranged to intersect the first and the second display electrodes. When a sustaining discharge is generated between the first and the second display electrode by applying an anode potential to one of the first and the second display electrode and a cathode potential to the other thereof, a potential lower than the anode potential and higher than the cathode potential is applied to the first and the second display electrode adjacent to the first and the second display electrode between which the sustaining discharge is generated.

16 Claims, 17 Drawing Sheets

PLASMA DISPLAY AND METHOD OF DRIVING THE SAME

CROSS-REFERENCE TO RELATED APPLICATIONS

This application is based upon and claims priority of Japanese Patent Application No. 2001-194823, filed on Jun. 27, 2001, the contents being incorporated herein by reference.

BACKGROUND OF THE INVENTION

1. Field of the Invention

The present invention relates to a plasma display and a method of driving the same.

2. Description of the Related Art

FIG. 11 is a diagram showing the basic configuration of a plasma display panel device. A control circuit portion 1101 controls an addressing driver 1102, a common electrode (X electrode) sustaining circuit 1103, a scanning electrode (Y electrode) sustaining circuit 1104, and a scanning driver 1105.

The addressing driver 1102 supplies predetermined voltages to addressing electrodes A1, A2, A3, . . . , Hereinafter, the addressing electrodes A1, A2, A3, . . . are respectively or generally called addressing electrodes Aj, and "j" means a subscript.

The scanning driver 1105 supplies predetermined voltages to scanning electrodes Y1, Y2, Y3, . . . according to the control of the control circuit portion 1101 and the scanning electrode sustaining circuit 1104. Hereinafter, the scanning electrodes Y1, Y2, Y3, . . . are respectively or generally called scanning electrodes Yi, and "i" means a subscript.

The common electrode sustaining circuit 1103 supplies the same voltage to common electrodes X1, X2, X3, . . . respectively. Hereinafter, the common electrodes X1, X2, X3, . . . are respectively or generally called common electrodes Xi, and "i" means a subscript. The respective common electrodes Xi are connected to one another and have the same voltage level.

In a display region 1107, the scanning electrodes Yi and the common electrodes Xi form rows extending in parallel in a horizontal direction, and the addressing electrodes Aj form columns extending in a vertical direction. The scanning electrodes Yi and the common electrodes Xi are arranged alternately in the vertical direction. A stripe rib structure in which ribs 1106 are arranged between the addressing electrodes Aj is provided.

The scanning electrodes Yi and the addressing electrodes Aj form a two-dimensional matrix composed of i rows and j columns. Display cells Cij are formed by intersections of the scanning electrodes Yi and the addressing electrodes Aj and the common electrodes Xi adjacent to the intersections correspondingly. The display cells Cij correspond to pixels, and thereby the display region 1107 can display a two-dimensional image.

FIG. 12A is a diagram showing the sectional structure of the display cell Cij in FIG. 11. The common electrode Xi and the scanning electrode Yi are formed on a front glass substrate 1211. Attached thereon is a dielectric layer 1212 to insulate them against a discharge space 1217, and further attached thereon is an MgO (magnesium oxide) protective film 1213.

Meanwhile, the addressing electrode Aj is formed on a back glass substrate 1214 disposed facing the front glass substrate 1211, and attached thereon is a dielectric layer 1215, and further attached thereon is a phosphor. Ne+Xe Penning gas or the like is sealed in the discharge space 1217 between the MgO protective film 1213 and the dielectric layer 1215.

FIG. 12B is a diagram for explaining a capacity Cp of an alternating current drive type plasma display. A capacity Ca is the capacity of the discharge space 1217 between the common electrode Xi and the scanning electrode Yi. A capacity Cb is the capacity of the dielectric layer 1212 between the common electrode Xi and the scanning electrode Yi. A capacity Cc is the capacity of the front glass substrate 1211 between the common electrode Xi and the scanning electrode Yi. The capacity between the electrodes Xi and Yi is determined by the total of these capacities Ca, Cb, and Cc.

FIG. 12C is a diagram for explaining glowing of the alternating current drive type plasma display. On the inner face of the rib 1216, red, blue, and green phosphors 1218 are respectively arranged and applied in a stripe pattern, and light 1221 is generated by exciting the phosphors 1218 by discharge between the common electrode Xi and the scanning electrode Yi.

FIG. 13 is a schematic diagram of one frame FR of an image. The image is composed of, for example, 60 frames per second. The one frame FR is composed of a first subframe SF1, a second subframe SF2, . . . , and a n-th subframe SFn. This "n" is, for example, 10 and corresponds to the number of tone bits. The subframes SF1, SF2, and so on are respectively or generally called subsrames SF hereinafter.

Each subframe SF is composed of a reset period Tr, an addressing period Ta, and a sustaining period (sustaining discharge period) Ts. During the reset period Tr, the display cells are initialized. During the addressing period Ta, whether to light or not to light the respective display cells can be selected according to address designation. The selected cell glows during the sustaining period Ts. The number of times of glowing (glowing time) differs from one SF to another. Thereby, the tone value can be determined.

FIG. 14 shows a driving method during the sustaining period Ts of a progressive mode plasma display according to a prior art. At a point in time t1, an anode potential Vsa is applied to common electrodes Xn−1, Xn, and Xn+1, and a cathode potential Vsb is applied to scanning electrodes Yn−1, Yn, and Yn+1. Thereby, high voltage is applied respectively between the common electrode Xn−1 and the scanning electrode Yn−1, between the common electrode Xn and the scanning electrode Yn, and between the common electrode Xn+1 and the scanning electrode Yn+1 to generate sustaining discharges 1410.

Subsequently, at a point in time t2, the cathode potential Vsb is applied to the common electrodes Xn−1, Xn, and Xn+1, and the anode potential Vsa is applied to the scanning electrodes Yn−1, Yn, and Yn+1. Thereby, high voltage is applied respectively between the common electrode Xn−1 and the scanning electrode Yn−1, between the common electrode Xn and the scanning electrode Yn, and between the common electrode Xn+1 and the scanning electrode Yn+1 to generate the sustaining discharges 1410.

Thereafter, at a point in time t3, the sustaining discharges 1410 are generated by applying the same potentials as at the point in time t1, and at a point in time t4, the sustaining discharges 1410 are generated by applying the same potentials as at the point in time t3.

FIG. 15 shows a driving method during the sustaining period Ts of an ALIS (Alternate Lighting of Surfaces) mode plasma display according to the prior art. At the point in time t1, the anode potential Vsa is applied to the common electrodes Xn−1 and Xn+1 in odd-numbered lines, and the cathode potential Vsb is applied to the scanning electrodes Yn−1 and Yn+1 in odd-numbered lines. Then, the cathode potential Vsb is applied to the common electrode Xn in an even-numbered line, and the anode potential Vsa is applied to the scanning electrode Yn in an even-numbered line. Thereby, high voltage is applied respectively between the common electrode Xn−1 and the scanning electrode Yn−1, between the common electrode Xn and the scanning electrode Yn, and between the common electrode Xn+1 and the scanning electrode Yn+1 to generate sustaining discharges 1510.

Subsequently, at the point in time t2, the cathode potential Vsb is applied to the common electrodes Xn−1 and Xn+1 in the odd-numbered lines, and the anode potential Vsa is applied to the scanning electrodes Yn−1 and Yn+1 in the odd-numbered lines. Then, the anode potential Vsa is applied to the common electrode Xn in the even-numbered line, and the cathode potential Vsb is applied to the scanning electrode Yn in the even-numbered line. Thereby, high voltage is applied respectively between the common electrode Xn−1 and the scanning electrode Yn−1, between the common electrode Xn and the scanning electrode Yn, and between the common electrode Xn+1 and the scanning electrode Yn+1 to generate the sustaining discharges 1510.

Thereafter, at the point in time t3, the sustaining discharges 1510 are generated by applying the same potentials as at the point in time t1, and at the point in time t4, the sustaining discharges 1510 are generated by applying the same potentials as at the point in time t3.

FIG. 16 shows an abnormal operation of excessive lighting during the sustaining period Ts. A case where a pair of the electrodes Xn and Yn is address-designated and a pair of the electrodes Xn−1 and Yn−1 and a pair of the electrodes Xn+1 and Yn+1 are not address-designated is shown. When the plasma display is in normal operation, a discharge is generated between the address-designated electrodes Xn and Yn. As a result, the display cell with the electrodes Xn and Yn is lighted, and the display cell with the electrodes Xn−1 and Yn−1 and the display cell with the electrodes Xn+1 and Yn+1 are not lighted.

In some cases, however, the display cells are not completely initialized due to poor initialization or the like during the reset period Tr (FIG. 13). Consequently, an unnecessary wall charge sometimes remains at the electrode Yn−1 or Xn+1. Thereby, a discharge is erroneously generated between the electrodes Yn and Xn+1 or between the electrodes Xn and Yn−1. As a result, a discharge is generated between the electrodes Xn+1 and Yn+1 or between the electrodes Xn−1 and Yn−1, whereby unnecessary excessive lighting occurs.

FIG. 17 shows an abnormal operation in which a display cell which should be lighted is not lighted during the sustaining period Ts. A case where the pair of the electrodes Xn and Yn, the pair of the Xn−1 and Yn−1, and the pair of the electrodes Xn+1 and Yn+1 are address-designated is shown. When the plasma display is in normal operation, all of the display cell with the electrodes Xn and Yn, the display cell with the electrodes Xn−1 and Yn−1, and the display cell with the electrodes Xn+1 and Yn+1 are lighted.

In some cases, however, the display cells are not completely initialized due to poor initialization or the like during the reset period Tr (FIG. 13). As a result, although discharges should be originally generated between the electrodes Xn+1 and Yn+1 and between the electrodes Xn−1 and Yn−1, discharges are sometimes erroneously generated between the electrodes Xn+1 and Yn and between the electrodes Yn−1 and Xn. Consequently, an abnormal operation, in which the display cell with the electrodes Xn+1 and Yn+1 and the display cell with the electrodes Xn−1 and Yn−1 are not lighted, occurs.

With the advance of high definition of the plasma display and an increase in the number of pixels, the adjacent display cells come closer to each other, and the influence of discharge interference increases, whereby the aforementioned problems remarkably arise. Although the ribs 1106 are provided between the addressing electrodes Aj in FIG. 11, partitions are not provided in the vertical direction in FIG. 11, and hence discharge interference in the vertical direction is prone to occur.

Generally, as shown in FIG. 16 and FIG. 17, the interval of a slit between the electrodes Xn and Yn between which a sustaining discharge is generated is narrowed, and the interval of a slit between the electrodes Yn and Xn+1 (Yn−1 and Xn) between which a sustaining discharge is not generated is widened, whereby discharges are separated, but when high definition advances as described above, the interval between the adjacent display cells can not be fully secured.

SUMMARY OF THE INVENTION

An object of the present invention is to provide a plasma display capable of a stable sustaining discharge by a reduction in the influence of adjacent display cells and a method of driving the same.

According to an aspect of the present invention, there is provided a plasma display, wherein a plurality of first display electrodes and a plurality of second display electrodes are arranged in parallel with one another, and a plurality of addressing electrodes are arranged to intersect the first and the second display electrodes, and wherein a driver for applying a potential lower than an anode potential and higher than a cathode potential to the first and the second display electrode adjacent to the first and the second display electrode between which a sustaining discharge is generated when the sustaining discharge is generated between the first and the second display electrode by applying the anode potential to one of the first and the second display electrode and the cathode potential to the other thereof is provided.

By applying the anode potential to one of the first and the second display electrode and the cathode potential to the other thereof, the sustaining discharge can be generated between the first and the second display electrode. On this occasion, by applying the potential lower than the anode potential and higher than the cathode potential to the first and the second display electrode adjacent to the first and the second electrode between which the sustaining discharge is generated, a display cell in which the sustaining discharge is generated can prevent a bad influence from a display cell adjacent thereto.

DETAILED DESCRIPTION OF THE PREFERRED EMBODIMENTS

Figure 1:
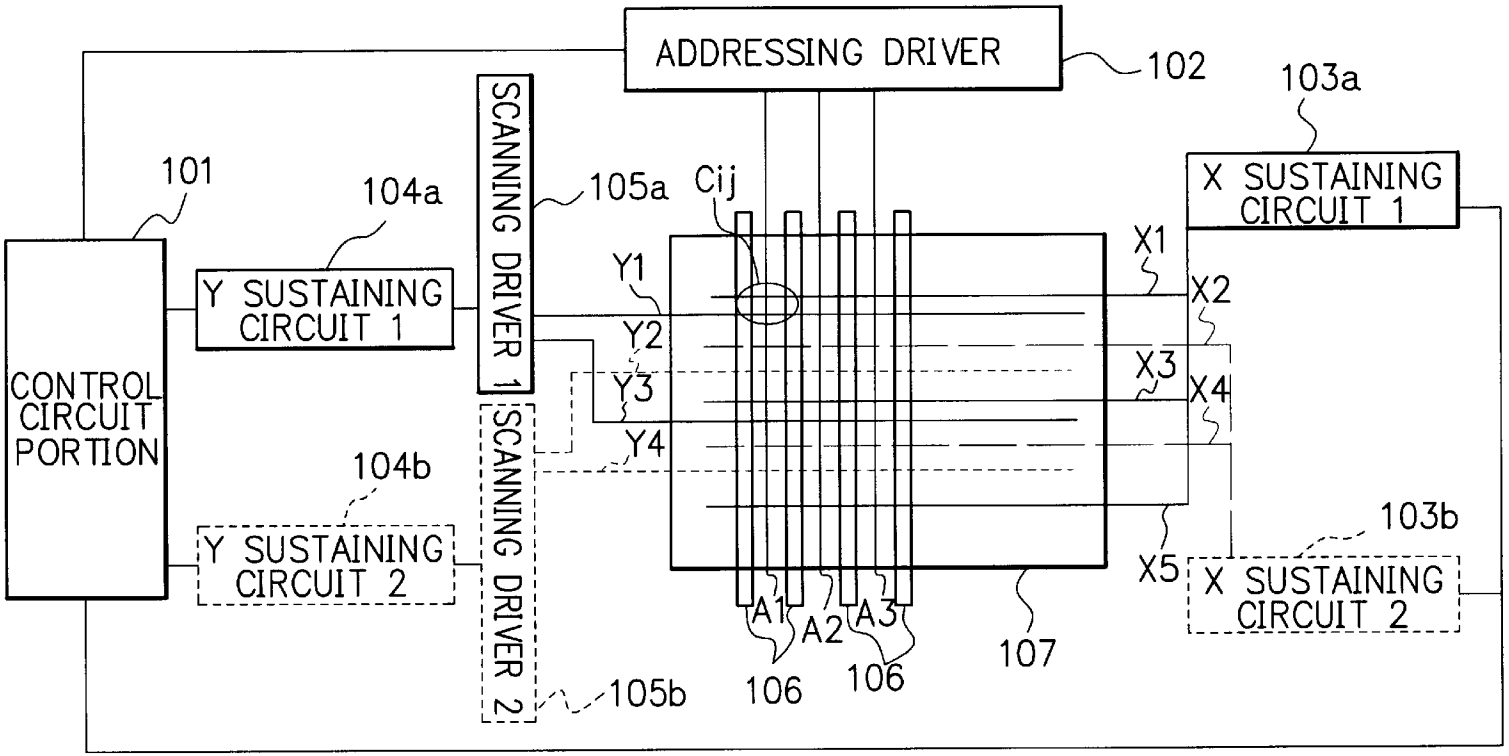
FIG. 1 is a block diagram of a plasma display device according to an embodiment of the present invention.

FIG. 1 is a diagram showing the configuration of a plasma display panel device according to an embodiment of the present invention. A control circuit portion 101 controls an addressing driver 102, common electrode (X electrode) sustaining circuits 103*a* and 103*b*, scanning electrode (Y electrode) sustaining circuits 104*a* and 104*b*, and scanning drivers 105*a* and 105*b*.

The addressing driver 102 supplies predetermined voltages to addressing electrodes A1, A2, A3, Hereinafter, the addressing electrodes A1, A2, A3, . . . are respectively or generally called addressing electrodes Aj, and "j" means a subscript.

The first scanning driver 105*a* supplies predetermined voltages to scanning electrodes (first display electrodes) Y1, Y3, . . . in odd-numbered lines according to the control of the control circuit portion 101 and the fist scanning electrode sustaining circuit 104*a*. The second scanning driver 105*b* supplies predetermined voltages to scanning electrodes Y2, Y4, . . . in even-numbered lines according to the control of the control circuit portion 101 and the second scanning electrode sustaining circuit 104*b*. Hereinafter, the scanning electrodes Y1, Y2, Y3, . . . are respectively or generally called scanning electrodes Yi, and "i" means a subscript.

The first common electrode sustaining circuit 103*a* supplies the same voltage to common electrodes (second display electrodes) X1, X3, . . . in odd-numbered lines respectively. The second common electrode sustaining circuit 103*b* supplies the same voltage to common electrodes X2, X4, . . . in even-numbered lines respectively. Hereinafter, the common electrodes X1, X2, X3, . . . are respectively or generally called common electrodes Xi, and "i" means a subscript. The common electrodes Xi in odd-numbered lines and even-numbered lines are respectively connected to one another and have the same voltage level.

In a display region 107, the scanning electrodes Yi and the common electrodes Xi form rows extending in parallel in a horizontal direction, and the addressing electrodes Aj form columns extending in a vertical direction. The scanning electrodes Yi and the common electrodes Xi are arranged alternately in the vertical direction. A stripe rib structure in which ribs 106 are arranged between the addressing electrodes Aj is provided.

The scanning electrodes Yi and the addressing electrodes Aj form a two-dimensional matrix composed of i rows and j columns. Display cells Cij are formed by intersections of the scanning electrodes Yi and the addressing electrodes Aj and the common electrodes Xi adjacent to the intersections correspondingly. The display cells Cij correspond to pixels, and thereby the display region 107 can display a two-dimensional image.

Figure 12A:
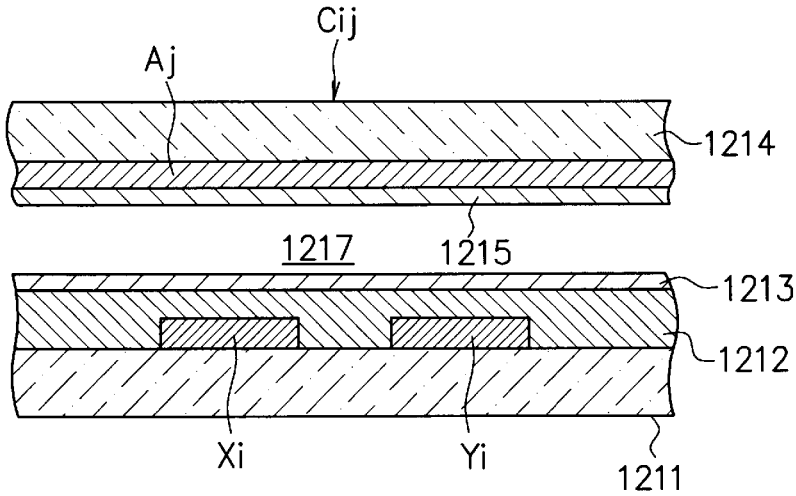
FIGS. 12A to 12C are sectional views of a display cell of the plasma display.
Figure 12B:
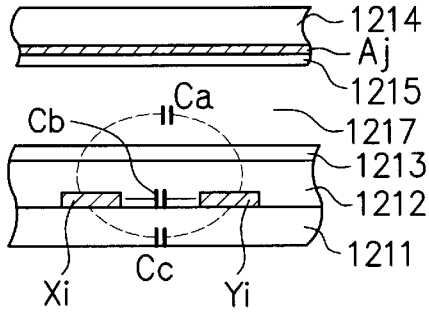
Figure 12C:
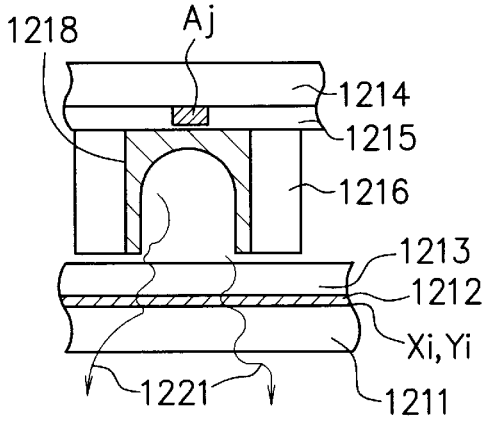
Figure 13:
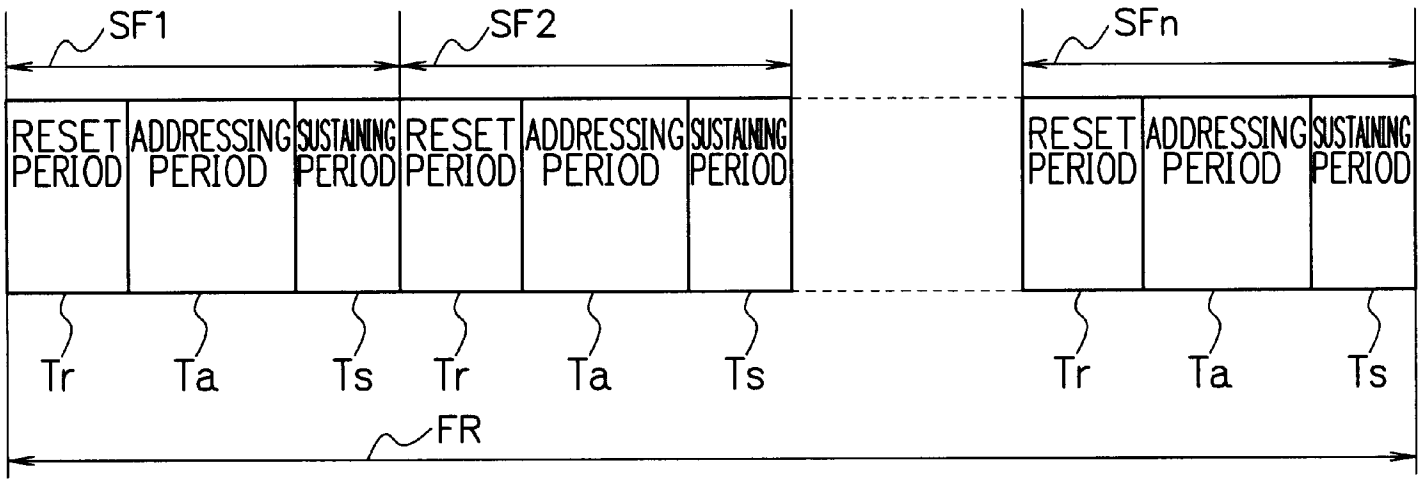
FIG. 13 is a schematic diagram of a frame of an image.
Figure 14:
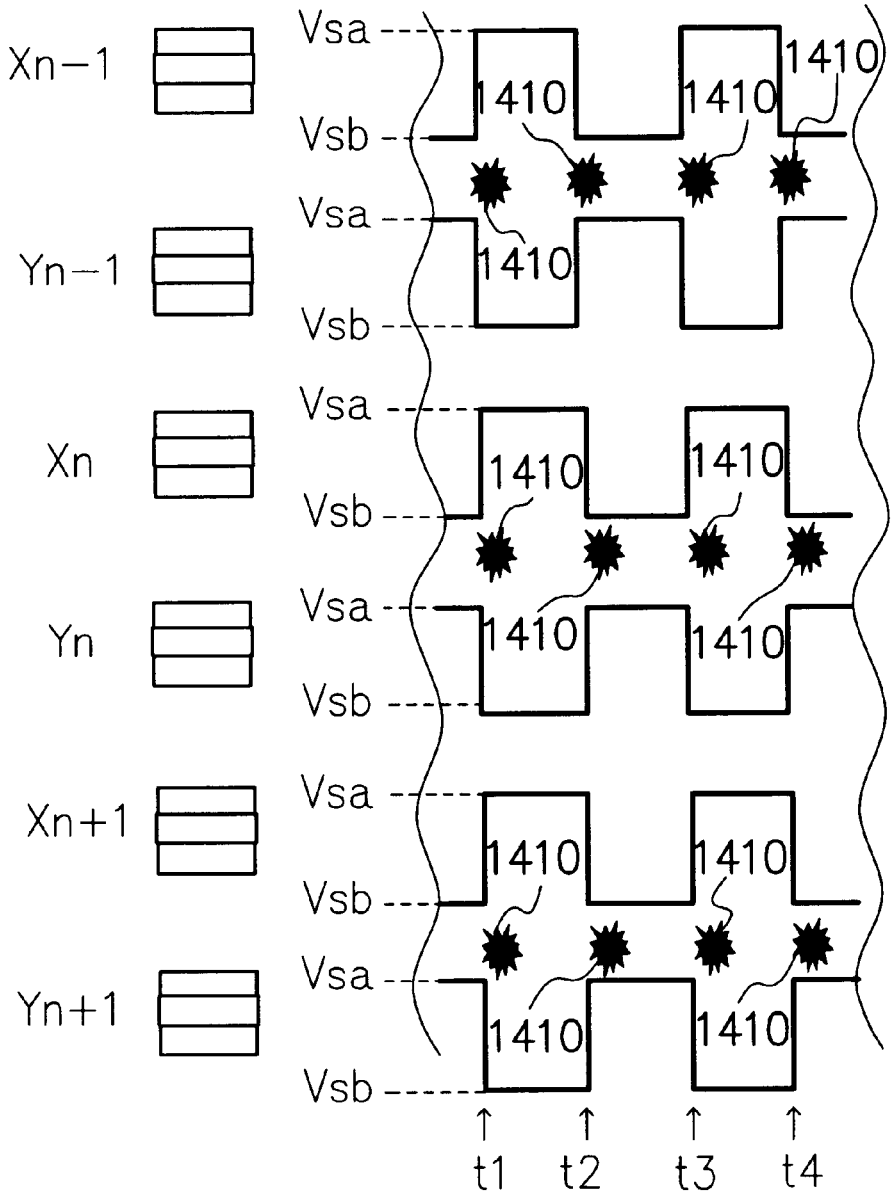
FIG. 14 PRIOR ART
FIG. 14 is a diagram showing waveforms during a sustaining period of a progressive mode plasma display according to a prior art.
Figure 15:
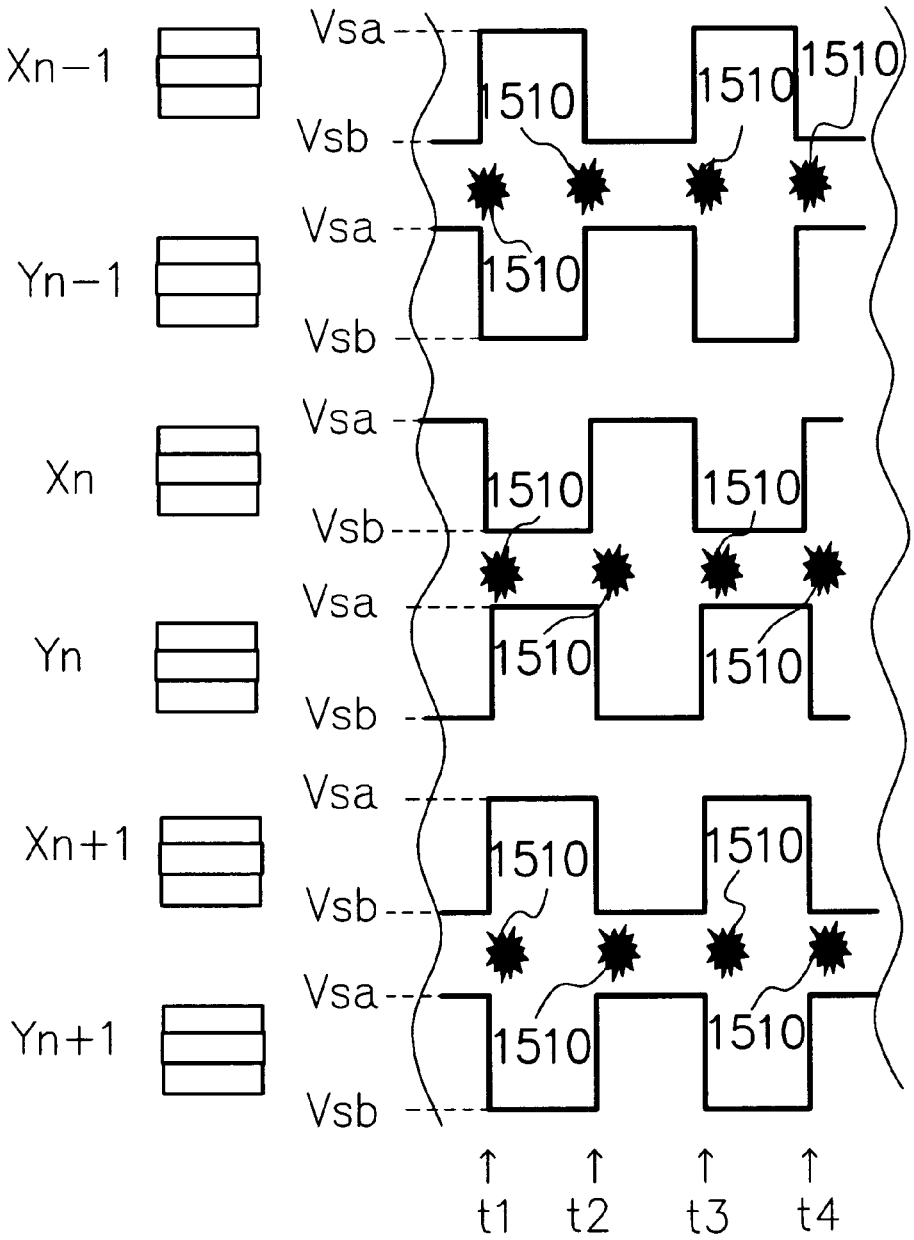
FIG. 15 PRIOR ART
FIG. 15 is a diagram showing waveforms during the sustaining period of an ALIS mode plasma display according to the prior art.

The structure of the display cell Cij is the same as that in FIG. 12. A frame of an image displayed by a plasma display is the same as that in FIG. 13.

Figure 2:
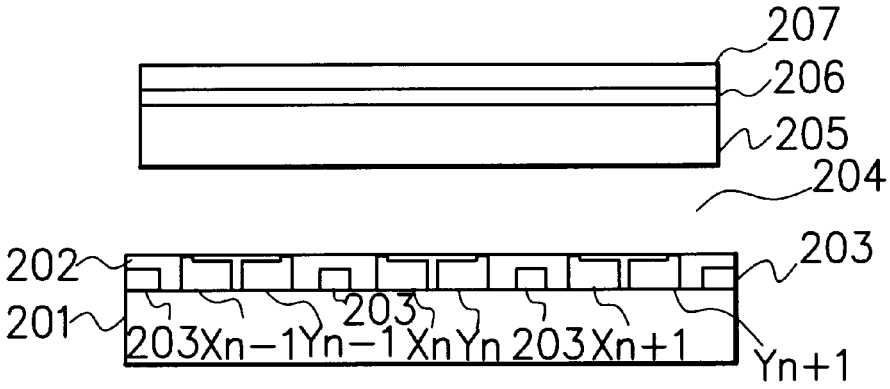
FIG. 2 is a sectional view of a progressive mode plasma display.

FIG. 2 is a sectional view of a progressive mode plasma display. A display cell with a common electrode Xn−1 and a scanning electrode Yn−1, a display cell with a common electrode Xn and a scanning electrode Yn, and a display cell with a common electrode Xn+1 and a scanning electrode Yn+1 are formed on a glass substrate 201. Light-interceptive members 203 are provided between the display cells. An insulating layer 202 is provided to cover the light-interceptive members 203 and the electrodes Xi and Yi.

An insulating layer 206 and a phosphor 205 are provided under an addressing electrode 207. A discharge space 204 is provided between the insulating layer 202 and the phosphor 205, and Ne+Xe Penning gas or the like is sealed therein. Discharge light at the discharge cell is displayed after being reflected by the phosphor 205 and penetrating the glass substrate 201.

In the progressive mode, intervals between the electrodes Xn−1 and Yn−1, the electrodes Xn and Yn, and the electrodes Xn+1 and Yn+1 which respectively form pairs composing display cells are narrow, and hence discharge is possible. Intervals between the electrodes Yn−1 and Xn, and the electrodes Yn and Xn+1 which lie across different display cells are wide, and hence discharge is not generated.

Concerning a more detailed art of the progressive mode, an art disclosed in U.S. Pat. No. 6,288,692 (Japanese Patent Laid-open No. Hei 10-207420, FR2758641) is incorporated herein by reference.

Figure 3:
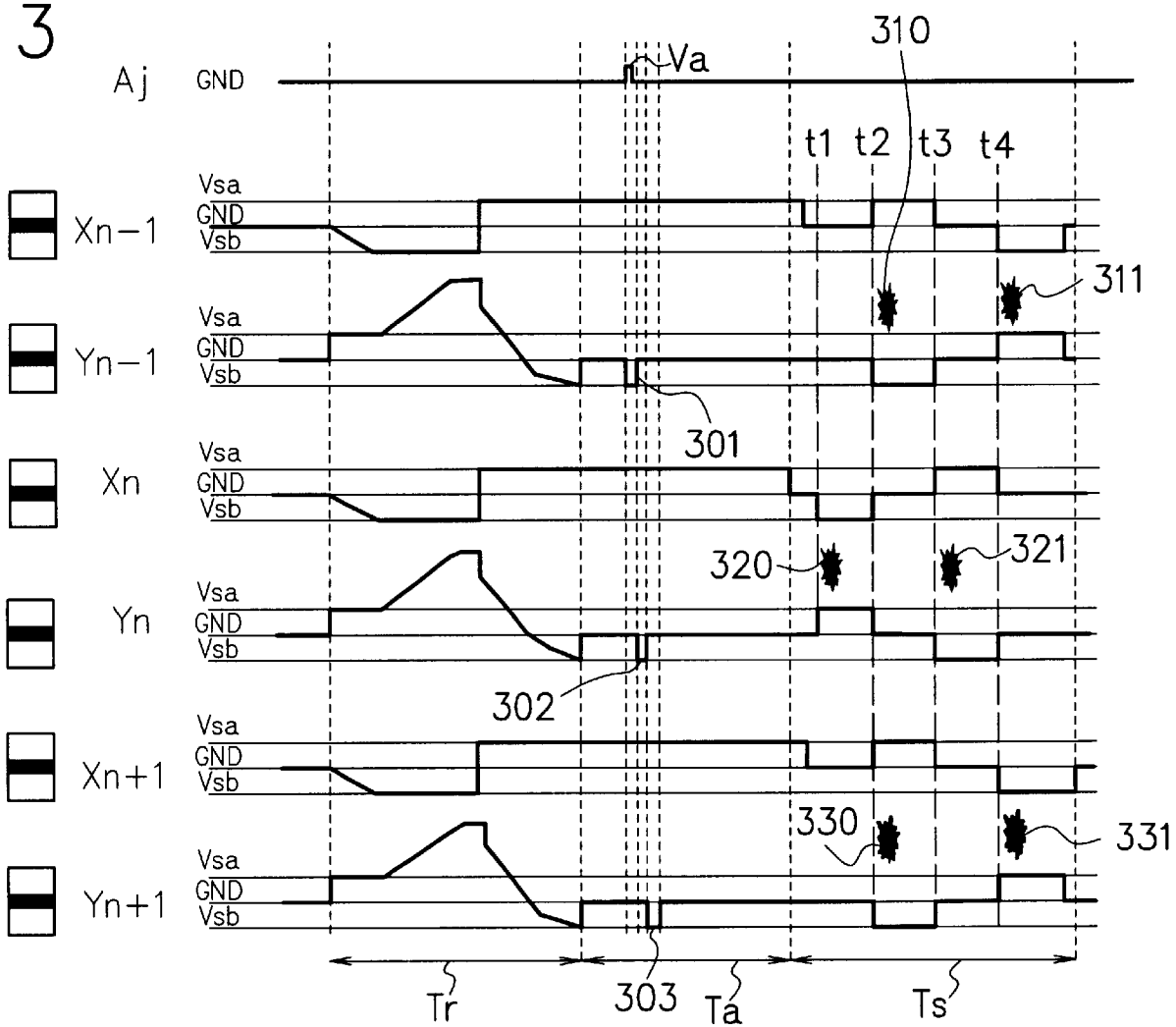
FIG. 3 is a timing chart showing a method of driving the progressive mode plasma display.

FIG. 3 is a timing chart showing a method of driving the progressive mode plasma display.

First, during a reset period Tr, predetermined voltages are respectively applied between the scanning electrodes Yi and the common electrodes Xi to perform overall write and overall erase of charges, erase previous display contents, and form predetermined wall charges.

Subsequently, during an addressing period Ta, a pulse having a positive potential Va is applied to the addressing electrode Aj, and pulses 301, 302 and 303 having a cathode potential Vsb is applied to desired scanning electrodes Yn−1, Yn, Yn+1, and so on sequentially by scanning. By these pulses 301 to 303, addressing discharges are generated between the addressing electrode Aj and the scanning electrodes Yn−1, Yn, and Yn+1, and the display cells are address-designated.

Thereafter, during a sustaining period (sustaining discharge period) Ts, opposite phase voltage is applied between the common electrodes Xi and the scanning electrodes Yi, whereby between the common electrode Xi and the scanning electrode Yi which correspond to the display cell address-designated during the addressing period Ta, a sustaining discharge is generated, and the display cell glows.

More specifically, at a point in time t1, a cathode potential Vsb is applied to the common electrode Xn in an even-numbered line, and an anode potential Vsa is applied to the scanning electrode Yn in an even-numbered line. Thereby, high voltage is applied between the common electrode Xn and the scanning electrode Yn to generate a sustaining discharge 320. On this occasion, a potential Vsc (for example, ground (GND)) is applied to the electrodes Xn−1, Yn−1, Xn+1, and Yn+1 in odd-numbered lines adjacent to the electrodes Xn and Yn in even-numbered lines between which the sustaining discharge is generated. The potential Vsc is an intermediate potential ((Vsa+Vsb)/2) between the anode potential Vsa and the cathode potential Vsb. Incidentally, the potential Vsc needs only to be lower than the anode potential Vsa and higher than the cathode potential Vsb. Consequently, the electrodes Xn and Yn can generate the stable discharge 320 without receiving a bad influence from the display cells adjacent thereto.

Subsequently, at a point in time t2, the anode potential Vsa is applied to the common electrodes Xn−1 and Xn+1 in the odd-numbered lines, and the cathode potential Vsb is applied to the scanning electrodes Yn−1 and Yn+1 in the odd-numbered lines. Thereby, high voltage is applied between the electrodes Xn−1 and Yn−1 and between the electrodes Xn+1 and Yn+1 to generate sustaining discharges 310 and 330. On this occasion, the potential Vsc (GND) is applied to the electrodes Xn and Yn in the even-numbered lines adjacent to the electrodes Xn−1, Yn−1, Xn+1, and Yn+1 in the odd-numbered lines which generate the sustaining discharges. Consequently, the electrodes Xn−1, Yn−1, Xn+1, and Yn+1 can generate the stable discharges 310 and 330 without receiving a bad influence from the display cells adjacent thereto.

Then, at a point in time t3, the anode potential Vsa is applied to the common electrode Xn in the even-numbered line, and the cathode potential Vsb is applied to the scanning electrode Yn in the even-numbered line. Thereby, high voltage is applied between the common electrode Xn and the scanning electrode Yn to generate a sustaining discharge 321. On this occasion, by applying the potential Vsc (GND) to the electrodes Xn−1, Yn−1, Xn+1, and Yn+1 in the odd-numbered lines adjacent to the electrodes Xn and Yn in the even-numbered lines which generate the sustaining discharge, the electrodes Xn and Yn can generate the stable discharge 321 without receiving a bad influence from the display cells adjacent thereto.

Subsequently, at a point in time t4, the cathode potential Vsb is applied to the common electrodes Xn−1 and Xn+1 in the odd-numbered lines, and the anode potential Vsa is applied to the scanning electrodes Yn−1 and Yn+1 in the odd-numbered lines. Thereby, high voltage is applied between the electrodes Xn−1 and Yn−1 and between the electrodes Xn+1 and Yn+1 to generate sustaining discharges 311 and 331. On this occasion, by applying the potential Vsc to the electrodes Xn and Yn in the even-numbered lines adjacent to the electrodes Xn−1, Yn−1, Xn+1, and Yn+1 in the odd-numbered lines which generate the sustaining discharges, the electrodes Xn−1, Yn−1, Xn+1, and Yn+1 can generate the stable discharges 311 and 331 without receiving a bad influence from the display cells adjacent thereto.

Hereafter, the operations from the point in time t1 to the point in time t4 are repeated. In this embodiment, the sustaining discharge between the electrodes Xn and Yn in the even-numbered lines and the sustaining discharges between the electrodes Xn−1 and Yn−1, and Xn+1 and Yn+1 in the odd-numbered lines are alternately generated. The aforementioned even-numbered lines and odd-numbered lines may be reversed.

Figure 6:
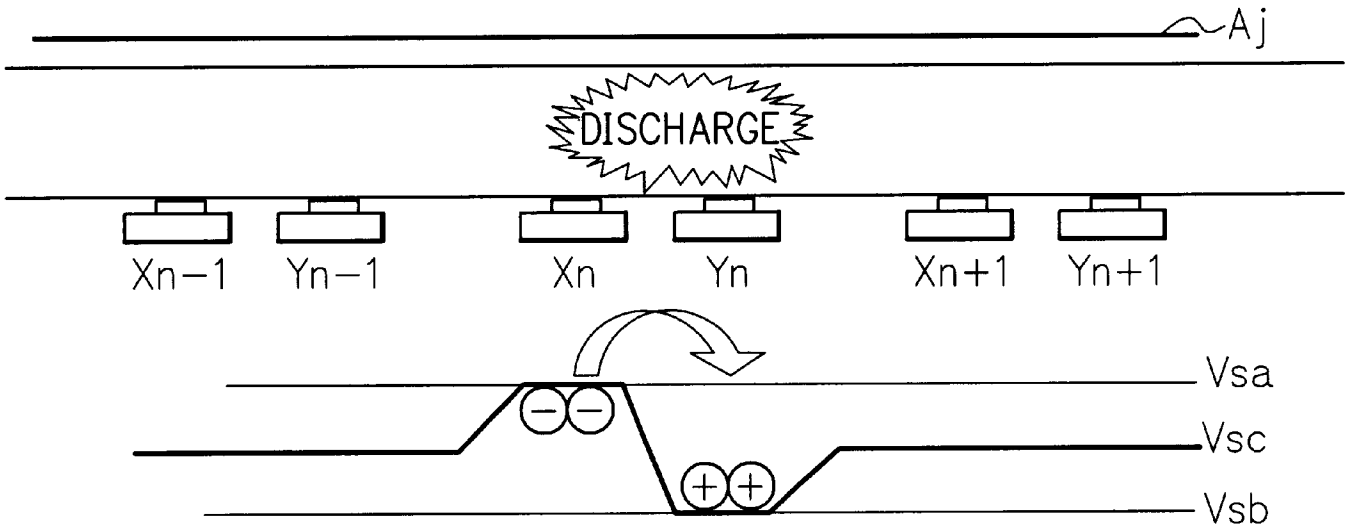
FIG. 6 is a diagram showing a state during the sustaining period according to the embodiment.

FIG. 6 shows a state at the point in time 3 in FIG. 3. An explanation is given with a case where a pair of the electrodes Xn and Yn is address-designated and a pair of the electrodes Xn−1 and Yn−1 and a pair of the electrodes Xn+1 and Yn+1 are not address-designated as an example. Hitherto, as shown in FIG. 16, there sometimes occurs a malfunction in which not only the display cell with the electrodes Xn and Yn is lighted but also the display cell with the electrodes Xn−1 and Yn−1 and the display cell with the electrodes Xn+1 and Yn+1 are lighted.

According to this embodiment, the anode potential Vsa and the cathode potential Vsb are respectively applied to the electrodes Xn and Yn in the even-numbered lines, and the potential Vsc is applied to the electrodes Xn−1, Yn−1, Xn+1, and Yn+1 in the odd-numbered lines. Consequently, the display cells in the even-numbered lines can generate sustaining discharges without receiving a bad influence from the display cells in the odd-numbered lines adjacent thereto. Namely, the electrodes Yn−1, Xn+1, and so on in the odd-numbered lines have the intermediate potential Vsc, whereby excessive discharges between the electrodes Xn and Yn−1 and between the electrodes Yn and Xn+1 can be prevented.

Figure 16:
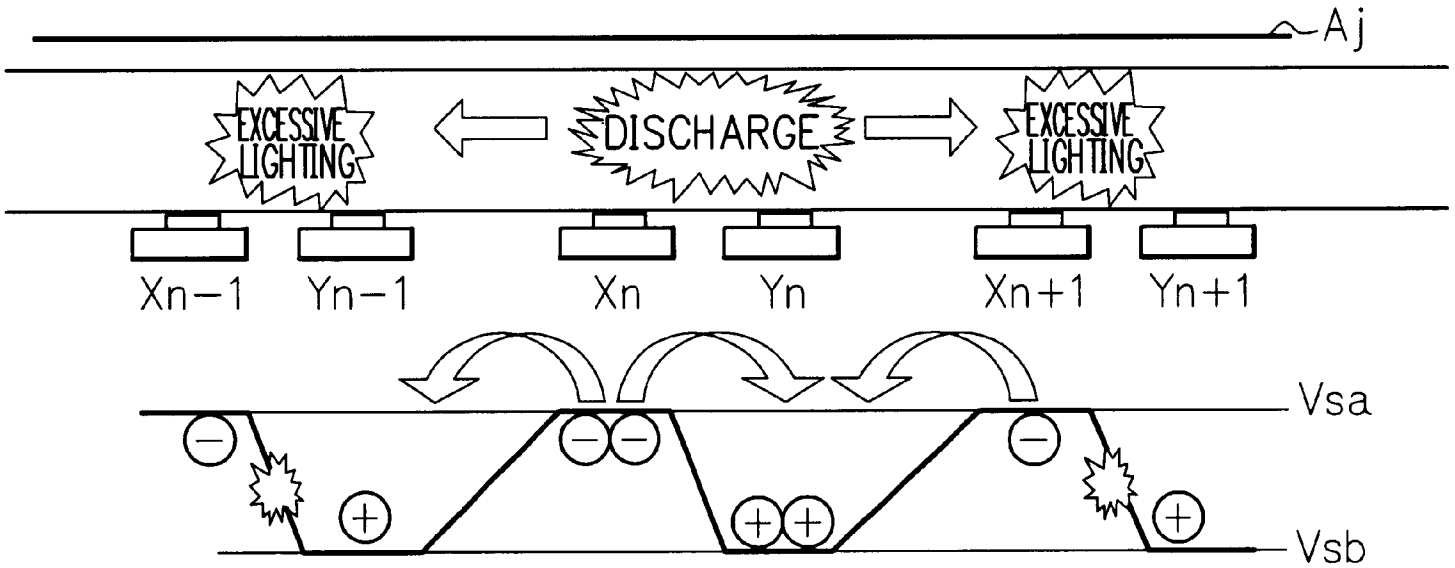
FIG. 16 PRIOR ART
FIG. 16 is a diagram showing a state of a malfunction of excessive lighting according to the prior art.

Assuming that the electrode Xn+1 has the anode potential Vsa, as shown in FIG. 16, excessive discharge is caused between the electrodes Yn and Xn+1. Moreover, assuming that the electrode Xn+1 has the cathode potential Vsb, the electrodes Yn and Xn+1 are regarded as the same electrode, and consequently sustaining discharges are caused between the electrodes Xn, Yn, and Xn+1.

Figure 17:
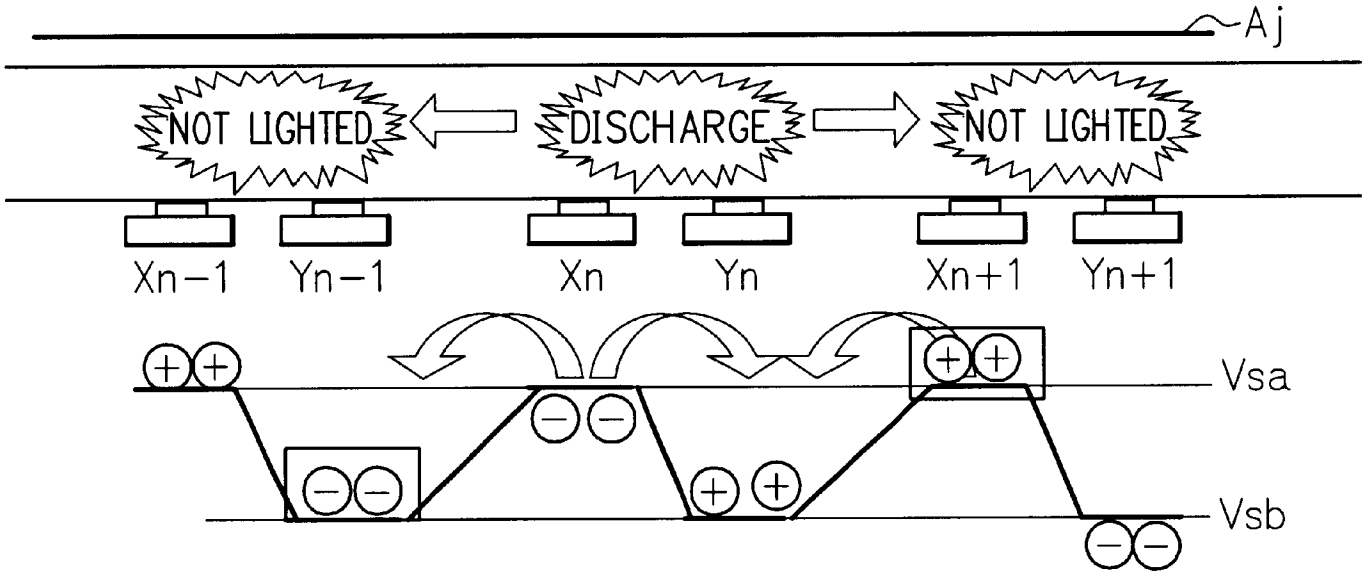
FIG. 17 PRIOR ART
FIG. 17 is a diagram showing a state of a malfunction in which lighting is not performed according to the prior art.

Next, a case where the pair of the electrodes Xn and Yn, the pair of the electrodes Xn−1 and Yn−1, and the pair of the electrodes Xn+1 and Yn+1 are address-designated will be explained. Hitherto, as shown in FIG. 17, the display cell with the electrodes Xn−1 and Yn−1 and the display cell with the electrodes Xn+1 and Yn+1 are not sometimes lighted erroneously. According to this embodiment, when the anode potential Vsa and the cathode potential Vsb are respectively applied to the common electrodes Xn−1 and Xn+1 and the scanning electrodes Yn−1 and Yn+1 in the odd-numbered lines, the intermediate potential Vsc is applied to the electrodes Xn and Yn in the even-numbered lines, whereby the display cells in the odd-numbered lines and even-numbered lines can be stably lighted respectively.

Since the stable sustaining discharge of a display cell without a bad influence from adjacent display cells is possible in this embodiment, the definition of the plasma display and an increase in the number of pixels can be attained. In this case, adjacent display cells come close to each other, but stable sustaining discharge is possible.

Figure 4:
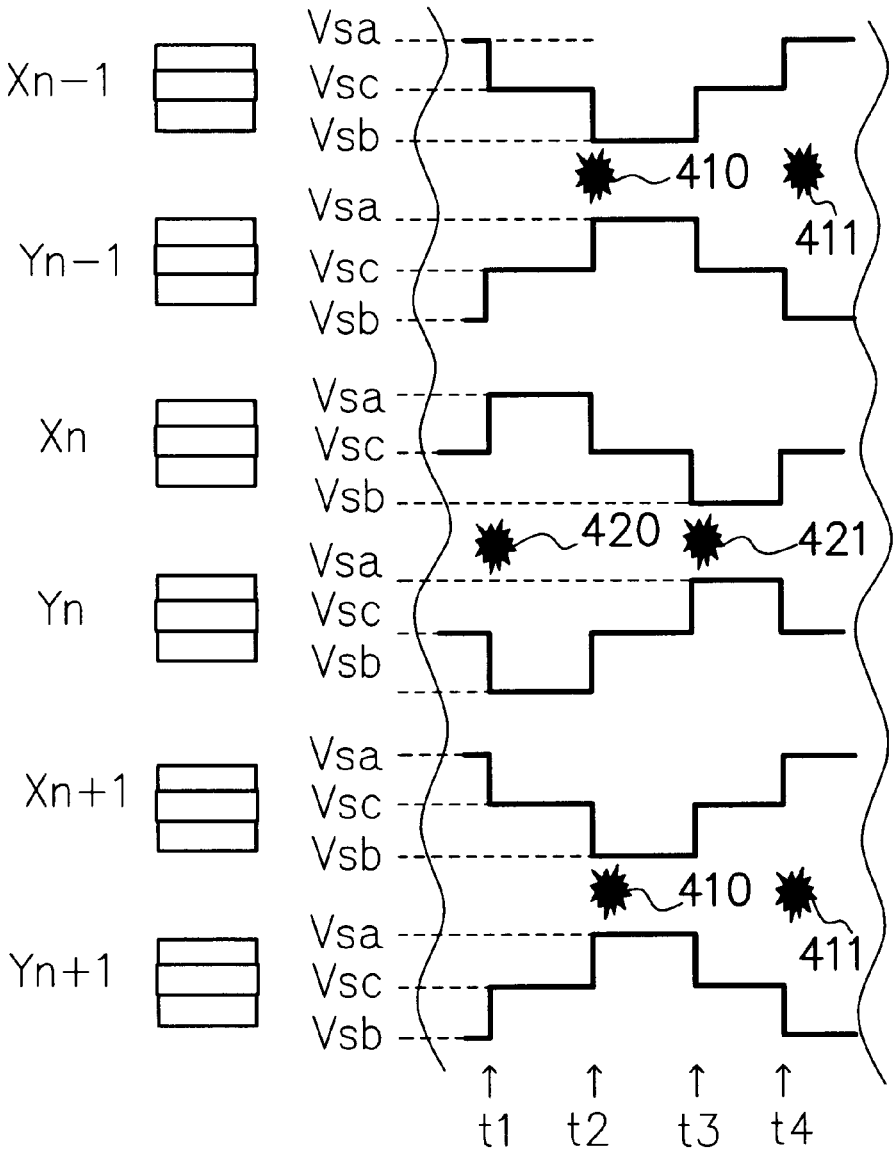
FIG. 4 is a timing chart showing waveforms during a sustaining period.

FIG. 4 shows other waveforms during the sustaining period Ts in FIG. 3. Points in time t1, t2, t3, and t4 correspond to the points in time t3, t4, t1, and t2 in FIG. 3 respectively. Namely, the operations may be started from the point in time t3 in FIG. 3, and the operations from the point in time t1 to the point in time t4 are repeated. Also in this case, sustaining discharges 420 and 421 between the electrodes Xn and Yn in the even-numbered lines and sustaining discharges 410 and 411 between the electrodes Xn−1 and Yn−1, and Xn+1 and Yn+1 in the odd-numbered lines are alternately generated.

Figure 5:
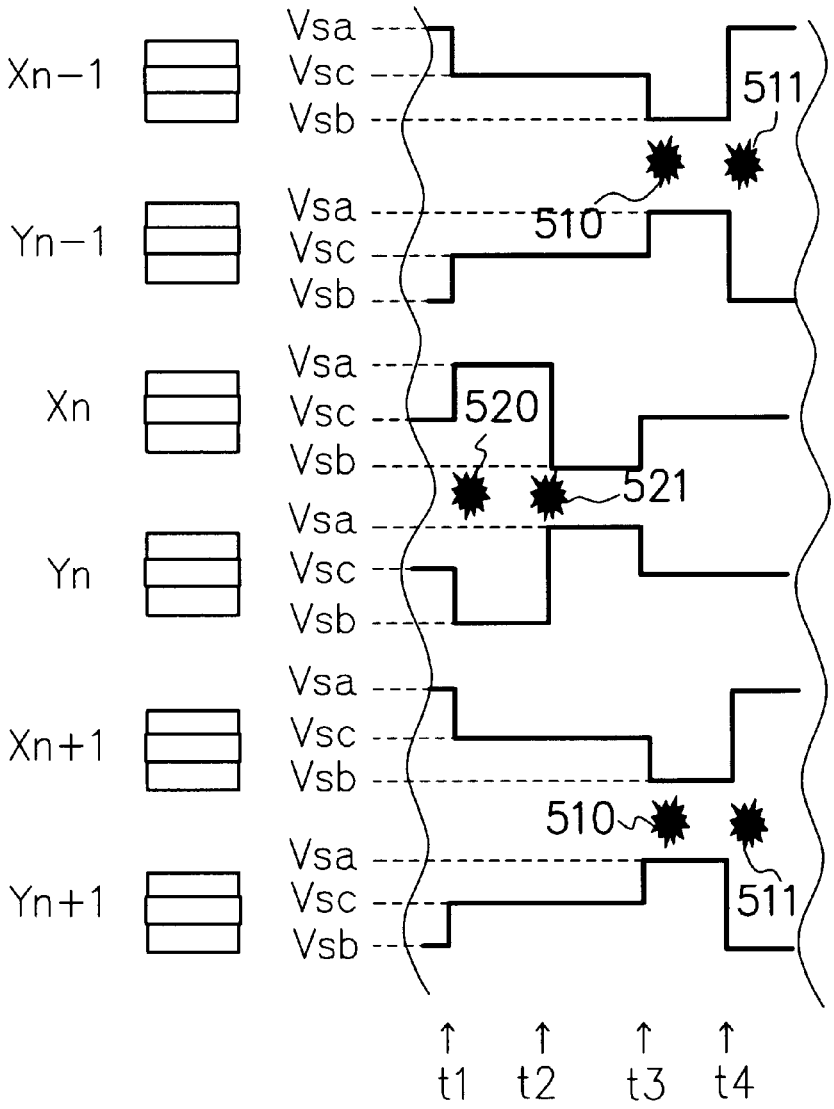
FIG. 5 is a timing chart showing other waveforms during the sustaining period.

FIG. 5 shows still other waveforms during the sustaining period Ts in FIG. 3. By applying the anode potential Vsa to the common electrode Xn in the even-numbered line and the cathode electrode Vsb to the scanning electrode Yn in the even-numbered line at the point in time t1, high voltage is applied between the common electrode Xn and the scanning electrode Yn to generate a sustaining discharge 520. On this occasion, by applying the intermediate potential Vsc to the electrodes Xn−1, Yn−1, Xn+1, and Yn+1 in the odd-numbered lines, the electrodes Xn and Yn can generate the stable sustaining discharge 520 without receiving a bad influence from the display cells adjacent thereto.

Subsequently, at the point in time t2, by applying the cathode potential Vsb to the common electrode Xn in the even-numbered line and the anode potential Vsa to the scanning electrode Yn in the even-numbered line, high voltage is applied between the common electrode Xn and the scanning electrode Yn to generate a sustaining discharge 521. On this occasion, by applying the intermediate potential Vsc to the electrodes Xn−1, Yn−1, Xn+1, and Yn+1 in the odd-numbered lines, the electrodes Xn and Yn can generate the stable sustaining discharge 521 without receiving a bad influence from the display cells adjacent thereto.

Then, by applying the cathode potential Vsb to the common electrodes Xn−1 and Xn+1 in the odd-numbered lines and applying the anode potential Vsa to the scanning electrodes Yn−1 and Yn+1 in the odd-numbered lines at the point in time t3, high voltage is applied between the electrodes Xn−1 and Yn−1 and between the electrodes Xn+1 and Yn+1 respectively to generate sustaining discharges 510. On this occasion, by applying the intermediate potential Vsc to the electrodes Xn and Yn in the even-numbered lines, the electrodes Xn−1, Yn−1, Xn+1, and Yn+1 can generate the stable sustaining discharges 510 without receiving a bad influence from the display cells adjacent thereto.

Subsequently, by applying the anode potential Vsa to the common electrodes Xn−1 and Xn+1 in the odd-numbered lines and applying the cathode potential Vsb to the scanning electrodes Yn−1 and Yn+1 in the odd-numbered lines at the point in time t4, high voltage is applied between the electrodes Xn−1 and Yn−1 and between the electrodes Xn+1 and Yn+1 respectively to generate sustaining discharges 511. On this occasion, by applying the intermediate potential Vsc to the electrodes Xn and Yn in the even-numbered lines, the electrodes Xn−1, Yn−1, Xn+1, and Yn+1 can generate the stable sustaining discharges 511 without receiving a bad influence from the display cells adjacent thereto.

Hereafter, the operations from the point in time t1 to the point in time t4 are repeated. In this case, the two sustaining discharges 520 and 521 are continuously generated between the electrodes Xn and Yn in the even-numbered lines, and thereafter the two sustaining discharges 510 and 511 are continuously generated between the electrodes Xn−1 and Yn−1, and Xn+1 and Yn+1 in the odd-numbered lines. Incidentally, it is suitable that after all sustaining discharges required between the electrodes Xn and Yn in the even-numbered lines are performed, all sustaining discharges required between the electrodes Xn−1 and Yn−1, and Xn+1 and Yn+1 in the odd-numbered lines are performed.

Figure 7:
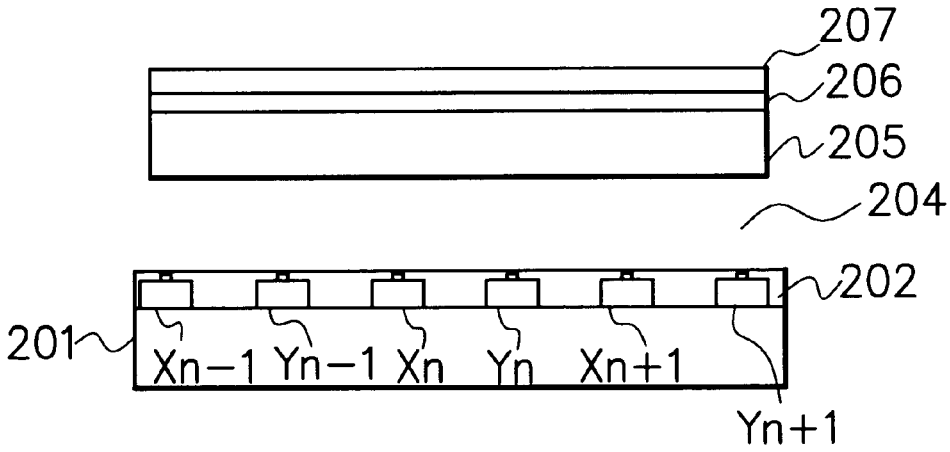
FIG. 7 is a sectional view of an ALIS mode plasma display.

FIG. 7 is a sectional view of an ALIS mode plasma display. This structure is basically the same as that of the progressive mode plasma display in FIG. 2. In the ALIS mode, however, all the intervals between the electrodes Xn−1, Yn−1, Xn, Yn, Xn+1, and Yn+1 are the same, and the light-interceptive members 203 do not exist. Gaps between the electrodes Xn−1 and Yn−1, between the electrodes Xn and Yn, and between the electrodes Xn+1 and Yn+1 are respectively defined as first slits, and gaps between the electrodes Yn−1 and Xn and between the electrodes Yn and Xn+1 are defined as second slits. In the ALIS mode, sustaining discharges in the first slits are performed in the first frame FR in FIG. 13, and sustaining discharges in the second slits are performed in the second frame FR subsequent to the first frame FR. In the ALIS mode, the number of display lines (rows) is double the number thereof in the progressive mode, and hence high definition can be realized. Concerning a more detailed art of the ALIS mode, an art disclosed in EP0762373 (Japanese Patent Laid-open No. Hei 09-160525, U.S. Ser. No./690038) is incorporated herein by reference.

Figure 8:
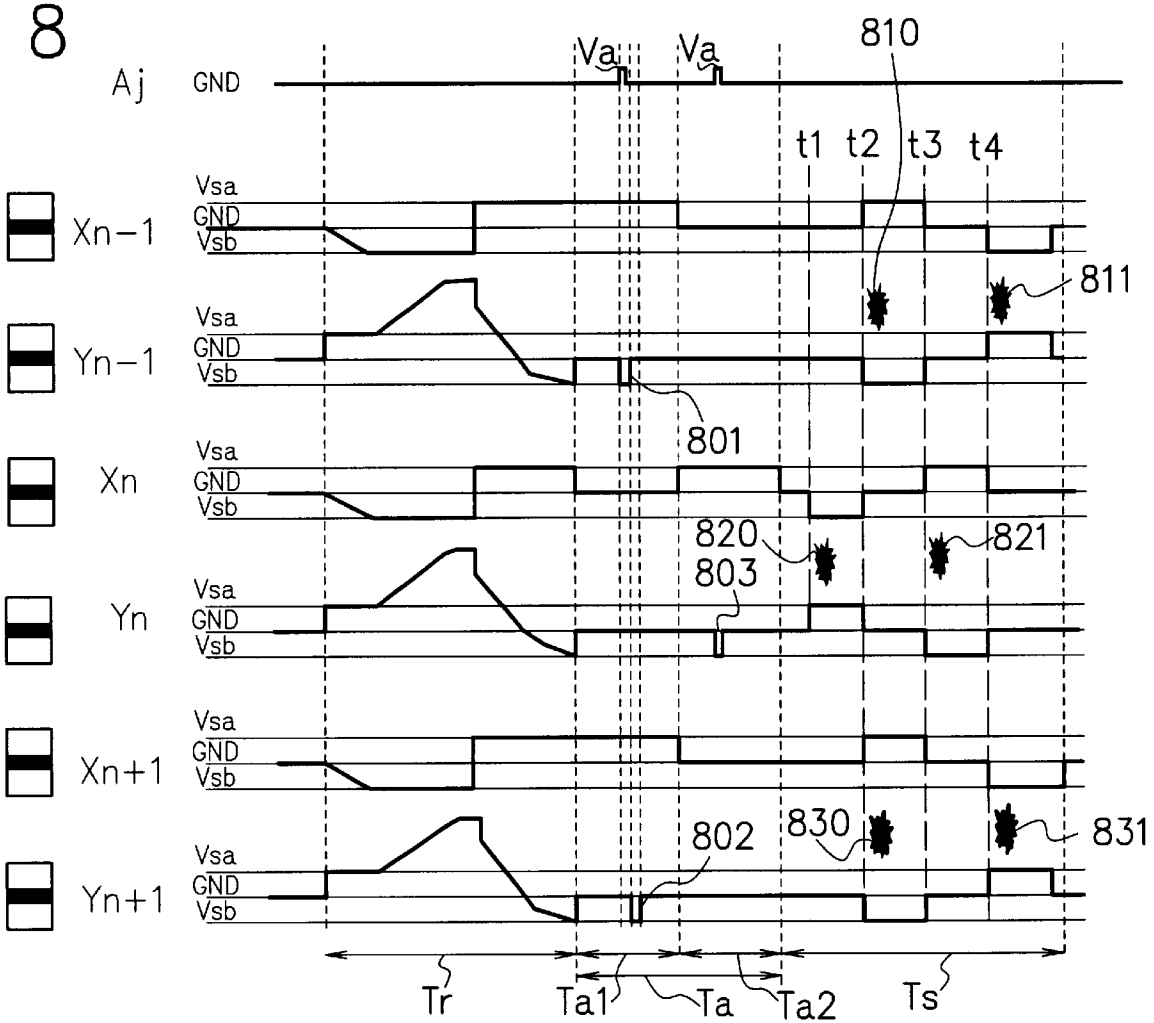
FIG. 8 is a timing chart showing a method of driving the ALIS mode plasma display.

FIG. 8 is a timing chart showing a method of driving the ALIS mode plasma display. The reset period Tr is the same as that in FIG. 3. The addressing period Ta is divided into a first half addressing period Ta1 and a second half addressing period Ta2. The first half addressing period Ta1 is a period for address-designating the scanning electrodes Yn−1 and Yn+1 in the odd-numbered lines sequentially by scanning. The second half addressing period Ta2 is a period for address-designating the scanning electrode Yn in the even-numbered line sequentially by scanning.

Namely, during the first half addressing period Ta1, a pulse having the positive potential Va is applied to the addressing electrode Aj, and pulses 801, 802, and so on having the cathode potential Vsb are applied to the scanning electrodes Yn−1, Yn+1, and so on in the odd-numbered lines sequentially by scanning.

During the second half addressing period Ta2, a pulse having the positive potential Va is applied to the addressing electrode Aj, and pulses 803 and so on having the cathode potential Vsb are applied to the scanning electrodes Yn and so on in the even-numbered lines sequentially by scanning.

Subsequently, operations during the sustaining period Ts are performed. The sustaining period Ts is the same as that in FIG. 3. Also in this case, sustaining discharges 820 and 821 between the electrodes Xn and Yn in the even-numbered lines and sustaining discharges 810 and 811, and 830 and 831 between the electrodes Xn−1 and Yn−1, and Xn+1 and Yn+1 in the odd-numbered lines can be generated alternately.

The aforementioned processing is processing in the first frame. In the first frame, sustaining discharges in the first slits are performed. Processing in the second frame is processing subsequent to the first frame, in which sustaining discharges in the second slits are performed. In the processing in the second frame, it is recommended that waveforms of the common electrodes Xn and so on in the even-numbered lines and the common electrodes Xn−1, Xn+1, and so on in the odd-numbered lines during the sustaining period Ts in FIG. 8 be exchanged. Namely, exchange of processing by the first common electrode sustaining circuit 103*a* and processing by the second common electrode sustaining circuit 103*b* in FIG. 1 is recommended. Incidentally, instead of the waveforms of the common electrodes, waveforms of the scanning electrodes may be exchanged.

In the ALIS mode, as shown in FIG. 7, the distances of the first slit and the second slit are the same, and hence malfunctions shown in FIG. 16 and FIG. 17 are prone to occur. According to this embodiment, even in the ALIS mode, each of the display cells can generate a stable sustaining discharge without being adversely affected by the display cells adjacent thereto.

Figure 9:
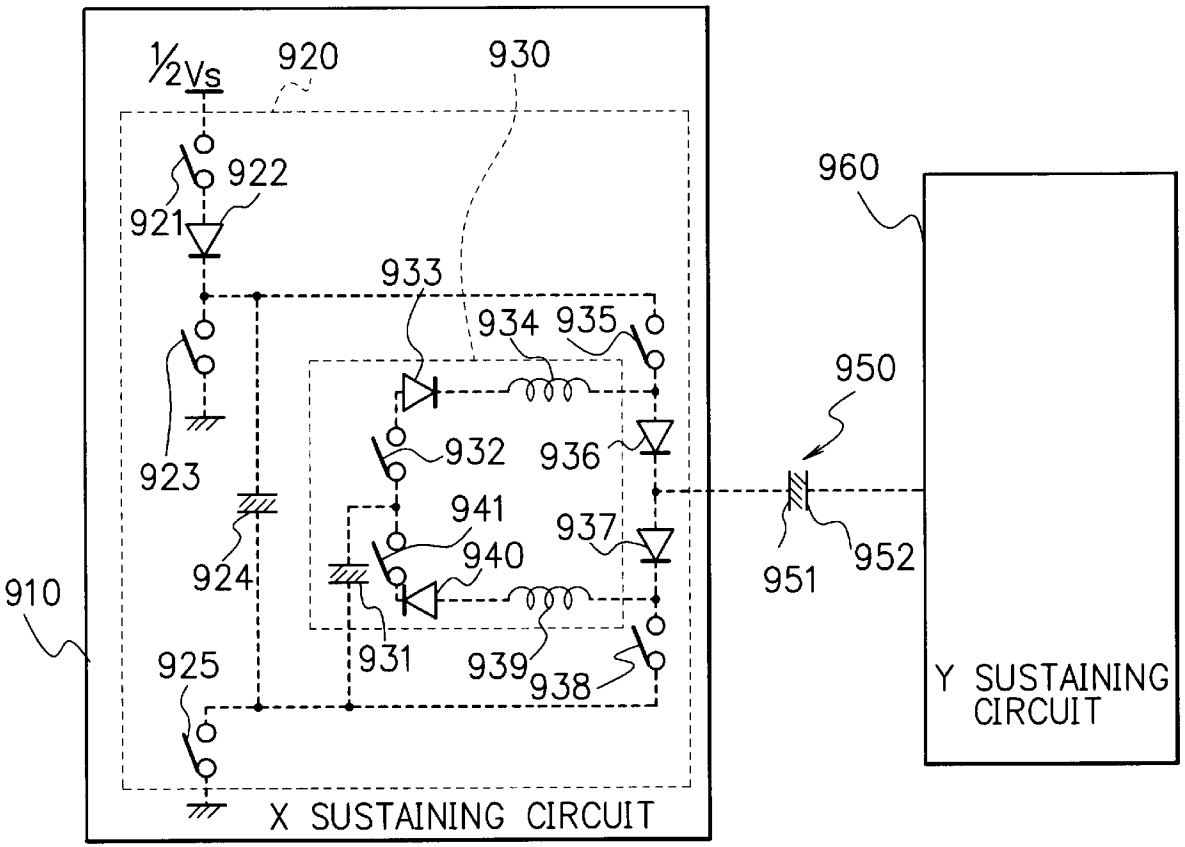
FIG. 9 is a circuit diagram of a common electrode sustaining circuit and a scanning electrode sustaining circuit.

FIG. 9 shows the configuration of a common electrode sustaining circuit 910 and a scanning electrode sustaining circuit 960. The common electrode sustaining circuit 910 corresponds to the common electrode sustaining circuits 103*a* and 103*b* in FIG. 1, and it is connected to a common electrode 951. The scanning electrode sustaining circuit 960 corresponds to the scanning electrode sustaining circuits 104*a* and 104*b* in FIG. 1, and it is connected to a scanning electrode 952. A capacitor 950 is composed of the common electrode 951, the scanning electrode 952, and an insulator between them.

The common electrode sustaining circuit 910 has a TERES (Technology of Reciprocal Sustainer) circuit 920 and a power recovery circuit 930.

First, the configuration of the TERES circuit 920 will be explained. An anode of a diode 922 is connected to a first potential (for example, Vs/2 [V]) via a switch 921, and a cathode thereof is connected to a second potential (for example, ground) lower than the first potential via a switch 923. One end of a capacitor 924 is connected to the cathode of the diode 922, and the other end thereof is connected to the second potential via a switch 925. An anode of a diode 936 is connected to the cathode of the diode 922 via a switch 935, and a cathode thereof is connected to the common electrode 951. An anode of a diode 937 is connected to the common electrode 951, and a cathode thereof is connected to the aforementioned other end of the capacitor 924 via a switch 938.

Next, the operation of the TERES circuit 920 without the power recovery circuit 930 will be explained. An explanation is given with the common electrode Xn in FIG. 4 as an example. At the point in time t1, the switches 921, 925, and 935 are closed, and the switches 923 and 938 are opened. Then, the potential of Vs/2 is applied to the common electrode 951 via the switches 921 and 935. The anode potential Vsa is, for example, Vs/2 [V]. Moreover, as for the capacitor 924, an electrode on the upper side in FIG. 9 (hereinafter referred to as an upper end) is connected to Vs/2, and an electrode on the lower side in FIG. 9 (hereinafter referred to as a lower end) is connected to the ground, and this capacitor is charged.

Then, at the point in time t2, the switches 925 and 938 are closed, and the switches 923 and 935 are opened. Then, the ground potential is applied to the common electrode 951 via the switches 925 and 938. The intermediate potential Vsc is, for example, the ground.

Subsequently, at the point in time t3, the switches 923 and 938 are closed, and the switches 921, 925, and 935 are opened. Then, the upper end of the capacitor 924 has the ground and the lower end thereof has −Vs/2. The cathode potential of −Vs/2 is applied to the common electrode 951 via the switch 938. The cathode potential Vsb is, for example, −Vs/2 [V].

Subsequently, at the point in time t4, the switches 923 and 935 are closed, and the switches 921, 925, and 938 are opened. Then, the ground potential is applied to the common electrode 951 via the switches 923 and 935. Hereafter, the operations from the point in time t1 to the point in time t4 are repeated.

The aforementioned use of the TERES circuit 920 makes it possible to generate the anode potential Vsc, the cathode potential Vsb, and the intermediate potential Vsc by a simple circuit configuration without a special circuit for generating the intermediate potential Vsc being required.

Next, the configuration of the power recovery circuit 930 will be explained. A lower end of a capacitor 931 is connected to the lower end of the capacitor 924. An anode of a diode 933 is connected to an upper end of the capacitor 931 via a switch 932, and a cathode thereof is connected to the anode of the diode 936 via a coil 934. An anode of a diode 940 is connected to the cathode of the diode 937 via a coil 939, and a cathode thereof is connected to the upper end of the capacitor 931 via a switch 941.

Figure 10:
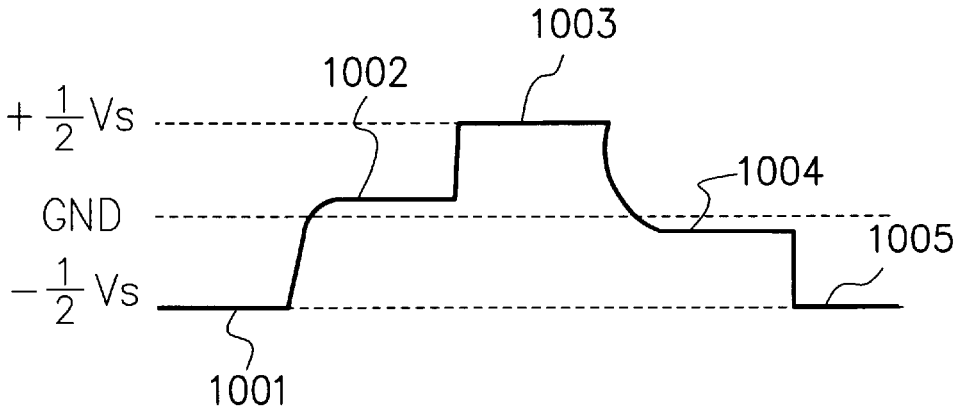
FIG. 10 is a diagram showing a sustaining discharge waveform by the use of a power recovery circuit.
Figure 11:
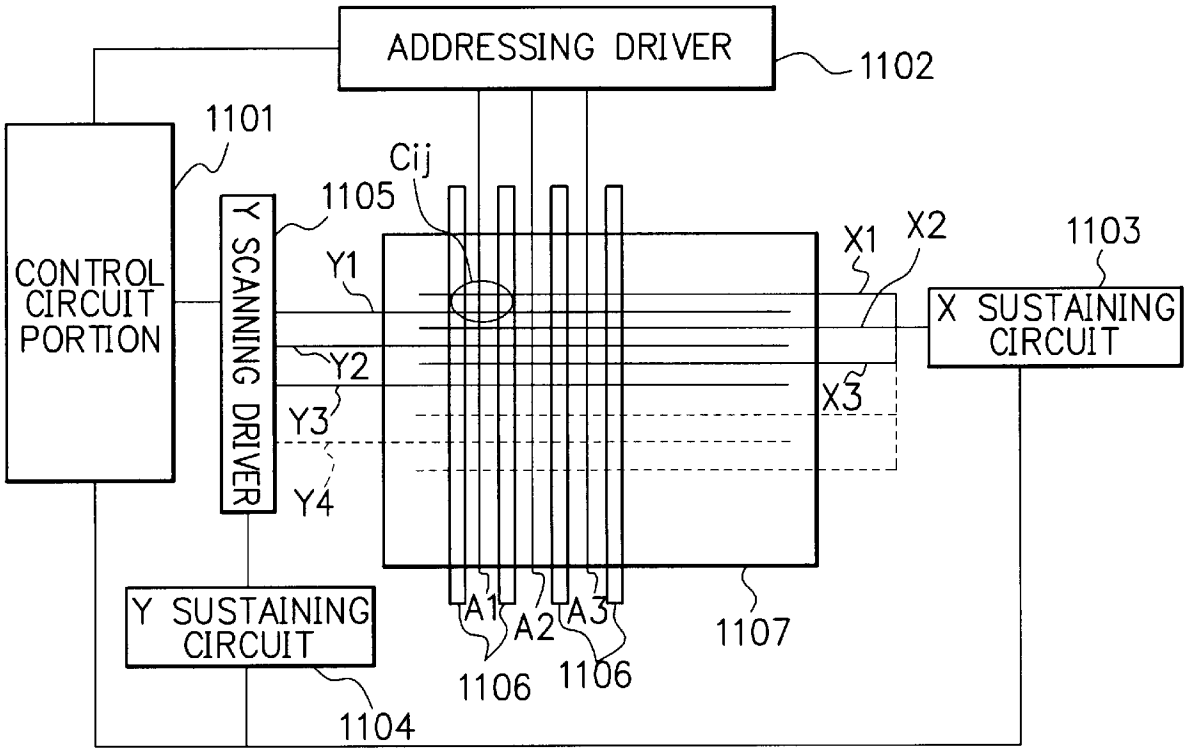
FIG. 11 is a block diagram of a plasma display device.

Next, the operation of the power recovery circuit 930 will be explained referring to FIG. 10. First, to generate a potential 1003, the switches 921 and 935 are closed, and the other switches are opened. Then, the potential of Vs/2 is applied to the common electrode 951 via the switches 921 and 935. The anode potential Vsa is, for example, Vs/2 [V].

Subsequently, to generate a potential 1004, the switches 925 and 941 are closed, and the other switches are opened. Then, a charge at the common electrode 951 is supplied to the upper end of the capacitor 931 via the coil 939. The lower end of the capacitor 931 is connected to the second potential (GND) via the switch 925. By LC resonance of the coil 939 and the capacitor 931, the capacitor 931 is charged, and electric power is recovered, whereby the potential drops to the potential 1004. Moreover, by the diodes 940 and 937, resonance is eliminated at the potential 1004, and the potential 1004 can be stabilized by the coil 939.

Subsequently, to generate a potential 1005, the switches 925 and 938 are closed, and the other switches are opened. Then, the potential 1005 of the common electrode 951 changes to the ground. A potential 1001 is the same as the potential 1005.

Thereafter, to generate a potential 1002, the switches 925 and 932 are closed, and the other switches are opened. An electric charge charged in the capacitor 931 is supplied to the common electrode 951 via the coil 934 and the diodes 933 and 936. As a result, the potential rises to the potential 1002 and becomes stable.

Subsequently, to generate the potential 1003, the switches 921 and 935 are closed, and the other switches are opened. Then, the potential 1003 of the common electrode 951 rises to Vs/2.

By repeating the aforementioned operations periodically, a waveform during the sustaining period Ts can be produced. The configuration of the scanning electrode sustaining circuit 960 is the same as that of the common electrode sustaining circuit 910. The use of the power recovery circuit 930 enables a rise in energy efficiency and a reduction in power consumption. Owing to the property of the power recovery circuit 930, the potential 1002 is slightly higher than the ground, and the potential 1004 is slightly lower than the ground, but the potential 1002 and the potential 1004 need not be the same, and both the potentials need only to be lower than the anode potential Vsa and higher than the cathode potential Vsb.

As stated above, according to this embodiment, by applying the anode potential Vsa to one of the common electrode (Xn) and the scanning electrode (Yn) and the cathode potential Vsb to the other thereof, a sustaining discharge can be generated between the common electrode (Xn) and the scanning electrode (Yn) On this occasion, by applying the potential Vsc, which is lower than the anode potential Vsa and higher than the cathode potential Vsb, to the common electrodes (Xn−1, Xn+1) and the scanning electrodes (Yn−1, Yn+1) adjacent to the common electrode (Xn) and the scanning electrode (Yn) between which the sustaining discharge is generated, a display cell in which the sustaining discharge is generated can prevent a bad influence from display cells adjacent thereto.

It should be noted that any of the above-described embodiments is just a concrete example for carrying out the present invention, and therefore the technical range of the present invention is not intended to be interpreted in a narrow sense by them. In other words, the present invention can be realized in various forms without departing from its technical idea or its primary characteristics.

As explained above, by applying an anode potential to one of a first and a second display electrode and a cathode electrode to the other thereof, a sustaining discharge can be generated between the first and the second display electrode. On this occasion, by applying a potential, which is lower than the anode potential and higher than the cathode potential, to a first and a second electrode adjacent to the first and the second electrode between which the sustaining discharge is generated, a display cell in which the sustaining discharge is generated can prevent a bad influence from display cells adjacent thereto.

What is claimed is:

1. A plasma display comprising:

a plurality of first display electrodes and a plurality of second display electrodes arranged in parallel with one another;

a plurality of addressing electrodes arranged to intersect the first and the second display electrodes; and a driver applying a potential lower than an anode potential and higher than a cathode potential to the first and the second display electrodes adjacent to the first and the second display electrodes between which a sustaining discharge is generated when the sustaining discharge is generated between the first and the second display electrodes by applying the anode potential to one of the first and the second display electrodes and the cathode potential to the other thereof.

2. The plasma display according to claim 1, wherein:

the driver applies an intermediate potential, between the anode potential and the cathode potential, to the first and the second display electrodes adjacent to the first and the second display electrodes between which the sustaining discharge is generated.

3. The plasma display according to claim 1, wherein the driver includes:

a first diode to whose anode a first potential is connected via a switch and to whose cathode a second potential, lower than the first potential, is connected via a switch;

a first capacitor to whose one end the cathode of the first diode is connected and to whose other end the second potential is connected via a switch;

a second diode to whose anode the cathode of the first diode is connected via a switch and to whose cathode the first or the second display electrode is connected; and a third diode to whose anode the first or the second display electrode is connected and to whose cathode the other end of the first capacitor is connected via a switch.

4. The plasma display according to claim 3, wherein:

the driver applies an intermediate potential, between the anode potential and the cathode potential, to the first and the second display electrodes adjacent to the first and the second display electrodes between which the sustaining discharge is generated.

5. The plasma display according to claim 3, wherein:

the driver has a power recovery circuit including a coil and a capacitor.

6. The plasma display according to claim 5, wherein:

said coil includes a first coil and a second coil; and the power recovery circuit comprises:

a second capacitor to whose one end the other end of the first capacitor is connected;

a fourth diode to whose anode another end of the second capacitor is connected via a switch and to whose cathode the anode of the second diode is connected via the first coil; and a fifth diode to whose anode the cathode of the third diode is connected via the second coil and to whose cathode the other end of the second capacitor is connected to a switch.

7. The plasma display according to claim 1, wherein the driver performs a sustaining discharge between a pair of the first and the second display electrodes and a sustaining discharge between a pair of the first and the second display electrodes adjacent thereto, alternately.

8. The plasma display according to claim 1, wherein the first display electrodes and the second display electrodes are arranged alternately, and the first display electrode is allowed to generate sustaining discharges for the adjacent second display electrodes on both sides thereof.

9. The plasma display according to claim 8, wherein:

a first distance between the first display electrode and the adjacent second display electrode on one side thereof and a second distance between the first display electrode and the adjacent second display electrode on the other side thereof are the same.

10. The plasma display according to claim 1, wherein:

the driver comprises a first driver connected to the first display electrode and a second driver connected to the second display electrode; and each of the first and the second driver comprises:

a first diode to whose anode a first potential is connected via a switch and to whose cathode a second potential lower than the first potential is connected via a switch;

a first capacitor to whose one end the cathode of the first diode is connected and to whose other end the second potential is connected via a switch;

a second diode to whose anode the cathode of the first diode is connected via a switch and to whose cathode the first or the second display electrode is connected; and a third diode to whose anode the first or the second display electrode is connected and to whose cathode the other end of the first capacitor is connected via a switch.

11. The plasma display according to claim 1, wherein:

the driver has a power recovery circuit including a coil and a capacitor.

12. The plasma display according to claim 1, wherein:

a reset period for initializing display cells and an addressing period for selecting a display cell to be lighted are executed before a sustaining discharge period for performing the sustaining discharge.

13. The plasma display according to claim 1, wherein:

the driver applies the potential, lower than the anode potential and higher than the cathode potential, to the first and the second display electrodes adjacent to one of the first and the second display electrodes between which the sustaining discharge is generated and the first and the second display electrodes adjacent to the other thereof.

14. The plasma display according to claim 1, wherein:

the first display electrodes and the second display electrodes are arranged alternately, and the first display electrode generates a sustaining discharge only for the adjacent second display electrode on one side thereof.

15. The plasma display according to claim 14, wherein:

a first distance between the first display electrode and the adjacent second display electrode on one side thereof and a second distance between the first display electrode and the adjacent second display electrode on the other side thereof are different.

16. A method of driving a plasma display in which a plurality of first display electrodes and a plurality of second electrodes are arranged in parallel with one another, and in which a plurality of addressing electrodes are arranged to intersect the first and the second display electrodes, comprising:

applying a potential lower than an anode potential and higher than a cathode potential to the first and the second display electrode adjacent to the first and the second display electrode between which a sustaining discharge is generated when the sustaining discharge is generated between the first and the second display electrode by applying the anode potential to one of the first and the second display electrode and the cathode potential to the other thereof.

* * * * *